United States Patent [19]

Gauvry

[11] Patent Number: 4,642,895

[45] Date of Patent: Feb. 17, 1987

[54] SCISSORS WITH ADJUSTABLE THUMB LOOP

[76] Inventor: Glenn A. Gauvry, 6100 Henry Ave., Apt. 7-N, Philadelphia, Pa. 19128

[21] Appl. No.: 794,826

[22] Filed: Nov. 4, 1985

[51] Int. Cl.[4] ..... B26B 13/20

[52] U.S. Cl. ..... 30/341; 30/271

[58] Field of Search ..... 30/341, 254, 257, 260, 30/271

[56] References Cited

U.S. PATENT DOCUMENTS

| | | | |
|---|---|---|---|
| 187,266 | 2/1977 | George | 30/271 X |
| 242,000 | 5/1981 | Klaucke | 30/341 |
| 359,890 | 3/1887 | Rue | 30/271 |
| 430,677 | 6/1890 | Pearsall | 30/341 |
| 440,436 | 11/1890 | Pearsall | 30/341 |
| 590,330 | 9/1897 | Nolen | 30/254 |
| 1,479,908 | 1/1924 | Goshia | 30/341 |
| 2,158,277 | 5/1939 | Dolph | 30/341 |
| 2,640,264 | 6/1953 | Sullivan et al. | 30/341 |
| 2,744,324 | 5/1956 | Chuba | 30/271 |
| 3,825,020 | 7/1974 | Myers | 30/341 |
| 4,184,249 | 1/1980 | Megna et al. | 30/341 |
| 4,254,551 | 3/1981 | Megna et al. | 30/341 |

FOREIGN PATENT DOCUMENTS

| | | | |
|---|---|---|---|
| 20501 | of 1911 | United Kingdom | 30/341 |

*Primary Examiner*—Jimmy C. Peters

*Attorney, Agent, or Firm*—Sperry, Zoda & Kane

[57] ABSTRACT

A scissors construction is disclosed including a first and second member pivotally mounted with respect to one another with conventional blade means being adjacent. A movably mounted thumb loop means is included interconnected with respect to the handle of the second member by way of a ball and socket interconnection allowing free movement longitudinally along and perpendicularly around the axis of the second handle. Also, a tab means is included to limit the rotational movement of the thumb means about the ball within the socket itself. A telescoping slide means is biased into contact with a slot defined therein extending circumferentially around the handle means and across the neck of the ball when positioned within the socket to thereby secure the ball therein in a movable fashion as described above. The finger loop in the first handle includes removable O-ring means to allow for various size fingers of users and may include a french lip extending downwardly therefrom to facilitate finger control of the first member.

16 Claims, 4 Drawing Figures

SCISSORS WITH ADJUSTABLE THUMB LOOP

BACKGROUND OF THE INVENTION

1. Field of the Invention

The present invention deals with the field of cutting devices, and in particular, scissors which include two adjacent blades which are movable toward and away from one another responsive to opening and closing of a finger of the user with respect to the thumb of the user. This type of construction for scissors is particularly usable for persons with variously sized thumbs or fingers, or is usable for someone who must use scissors for extended periods of time such as barbers or seamstresses. The flexibility and positioning of the thumb aids in both comfortness and utility.

2. Description of the Prior Art

Various patents have been granted on devices including non-standard thumb and finger gripping apertures to facilitate usage thereof such as U.S. Pat. No. 187,713 granted Feb. 27, 1877 to T. A. Kelly on Reversible Scissors; and U.S. Pat. No. 242,000 patented May 24, 1981 to J. Klaucke for Scissors; and U.S. Pat. No. 430,677 patented June 24, 1890 to R. S. Pearsall for Shears; and U.S. Pat. No. 440,436 patented Nov. 11, 1890 to R. S. Pearsall for Shears; and U.S. Pat. No. 590,330 patented Sept. 21, 1897 to S. A. Nolen for Scissors or Shears; and U.S. Pat. No. 919,211 patented Apr. 20, 1909 to N. W. Race for Barber's Shears; and U.S. Pat. No. 1,479,908 patented Jan. 8, 1924 to A. H. Goshia for Scissors; and U.S. Pat. No. 2,158,255 patented May 16, 1939 to V. H. Dolph for Shears; and U.S. Pat. No. 2,744,324 patented May 8, 1956 to G. J. Chuba for Barber Shears; and U.S. Pat. No. 2,640,264 patented June 2, 1953 to C. J. Sullivan et al for Thumb Guide Shear Handle; and U.S. Pat. No. 4,146,961 patented Apr. 3, 1979 to Frank Pinto for Scissors; and U.S. Pat. No. 4,184,249 patented Jan. 22, 1980 to Salvatori G. Megna, et al for Scissors-Like Tool; and U.S. Pat. No. 4,254,551 patented Mar. 10, 1981 to Salvatori G. Megna, et al for Scissors-Like Tool.

SUMMARY OF THE INVENTION

The present invention comprises a scissors having a first member with a first blade at one end thereof and a first handle at the other end thereof. The scissors also include a second member having a second blade at one end thereof and a second handle at the other end thereof and being pivotally secured with respect to the first member in the approximate center locations of each member in such a manner that the handles of each member are adjacent to one another and the blades of each member are adjacent to one another.

A first gripping means is located on the first handle means to facilitate gripping thereof by the fingers of a user, and a second gripping means is located on the second handle means to facilitate securement of the thumb of the user movably with respect to the second handle. This second gripping means may comprise a thumb loop means more particularly which is movably secured with respect to the second handle to allow a movable interconnection. In particular, the thumb loop itself is movable longitudinally along the axis of the second handle, as well as being movable perpendicularly about the axis of the second handle.

This movable interconnection means which allows this movement of the thumb loop means with respect to the second handle, includes a ball fixedly secured with respect to the thumb loop and a socket which is defined within the second handle and is adapted to receive the ball therein. This ball and socket interconnection is fixedly held in place by way of a telescoping slide which extends peripherally and longitudinally along the handle and defines a slot therein which can be selectively placed surrounding the neck of the ball as it extends into the socket to fixedly hold the ball therein but allow the ball to have a certain limited degree of movement. This slot means can be urged away from the socket allowing the ball to be removed for changing of the thumb loop if desired for maintenance or for a different sized loop.

A biasing means such as a coil spring means may also preferably be included within the telescoping slide to urge the slot thereof into contact with the ball means for movable securement therein. The user can slide the telescoping slide member away from the socket to allow removal of the ball.

The present invention may further include a tab which extends downwardly from the thumb loop and is fixedly secured with respect thereto to selectively abut the second handle and limit movement of the thumb loop to retain the loop side which is adapted to receive the thumb always pointing in a direction generally away from the blades.

To facilitate closing action of the blades with respect to one another, a stop means may be fixedly secured with respect to either the first or second handle means such that the opposite handle means will contact the stop to limit the full extent of movement of the blades toward one another. To facilitate the actual contact moment of the stop means with respect to the respective handle means, a rubber tip means may be included fixedly secured thereon.

The first handle means preferably will include a finger loop designed to receive one of the fingers of the user, as well as a french lip extending downwardly therefrom to allow placement of another finger thereagainst for further control. Also, this finger loop may include an O-ring means detachably securable therein to facilitate control or to provide a variability in sizing of the finger loop.

It is an object of the present invention to provide a scissors construction which includes a movable thumb loop.

It is an object of the present invention to provide a scissors construction including a thumb loop which is movable longitudinally along and perpendicularly around the axis of the second handle to which it is attached.

It is an object of the present invention to provide a scissors construction which is easy to use and easy to maintain.

It is an object of the present invention to provide scissors construction which can be used at a greater variety of angles with respect to the hand and arm of the user than is capable with conventional scissors construction.

It is an object of the present invention to provide a scissors construction which allows for detachable thumb loops for various sized thumbs of users.

It is an object of the present invention to provide a scissors construction with detachable O-rings within the finger holes to allow for usage by users having various sized fingers.

It is an object of the present invention to provide a scissors construction including a slidable engagement means adapted to selectively secure a thumb loop with respect to the handle designed to be operated by the thumb of a user.

It is an object of the present invention to provide a scissors construction which can be closed completely and gently by way of a rubber tip stop means.

It is an object of the present invention to provide a scissors construction which is relatively simple in construction and inexpensive.

It is an object of the present invention to provide a scissors construction wherein the thumb can assume the most natural angle and position with respect to any wrist angle.

It is an object of the present invention to provide a scissors construction with a movable thumb piece which can be made of metal or plastic.

It is an object of the present invention to provide a scissors construction utilizing a ball and socket interconnection means for movably attaching the thumb loop with respect to the handle controlled thereby.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
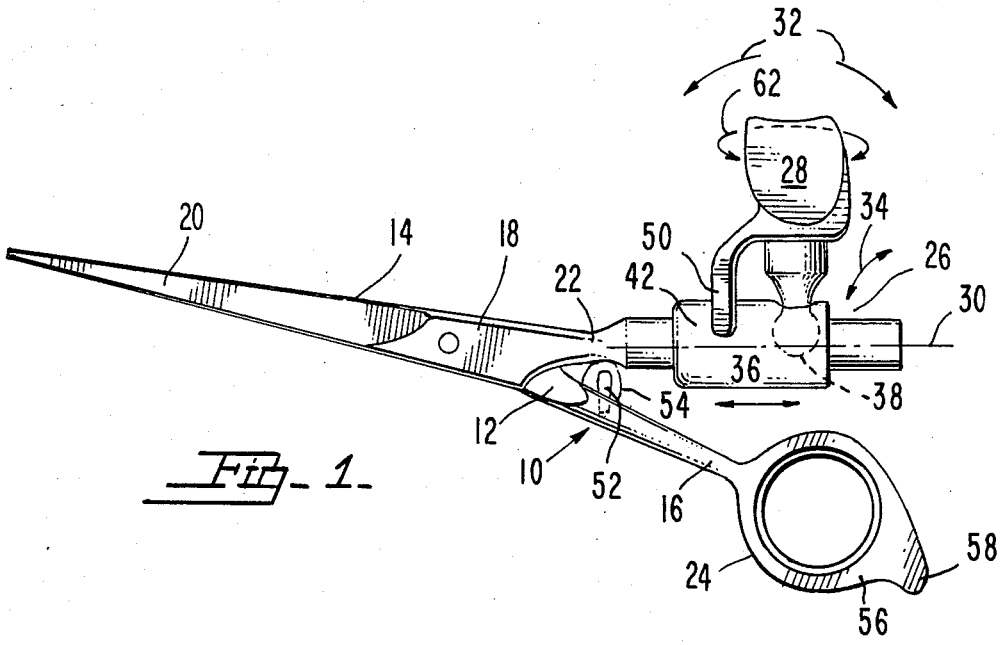
FIG. 1 is a front plan view of an embodiment of the scissors construction of the present invention.
Figure 2:
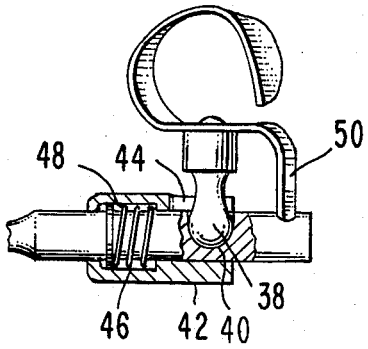
FIG. 2 is a cross sectional view of an embodiment of the movable interconnecting means between the thumb loop and a scissor handle of the present invention.
Figure 3:
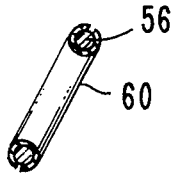
FIG. 3 is a cross sectional view through the finger loop of an embodiment of the present invention.
Figure 4:
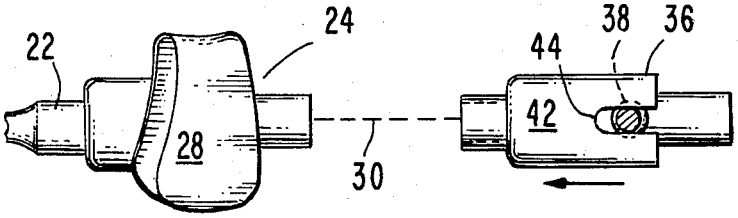
FIG. 4 is an assembly view of an embodiment of the movable interconnection means of the present invention.

The present invention provides a scissors construction 10 which includes a first member 12 and a second member 18 which are pivotally secured in the center area thereof with respect to one another. First member 12 includes a first blade means 14 and a first handle means 16 at opposite ends thereof. Similarly, the second member includes a second blade means 20 and a second handle means 22 at opposite ends thereof. The pivotal securement maintains the first blade means 14 adjacent to the second blade means 20 and the first handle means 16 adjacent to the second handle means 22. To facilitate grasping of the first handle means 16, a first gripping means 24 is included, and to facilitate grasping of the second handle means 22, a second gripping means 26 may be included.

The second gripping means 26 may preferably include a thumb loop means 28 which is movably mounted with respect to the second handle means 22. Second handle means 22 defines an axis 30 extending axially therealong, and the thumb loop means 28 is movable longitudinal along the axis 30 as shown by arrow 32, as well as perpendicularly around axis 30 as shown by arrow 34.

The mounting of the thumb loop means 28 with respect to the second handle means 22 is by way of a movable interconnecting means 36. This may take the form of a ball means 38 which is fixedly secured with respect to the thumb loop means 28 and a socket means 40 defined within the second handle means 22.

A telescoping slide means 42 may be positioned concentrically about the outer periphery of the second handle means 22 in such a manner as to be slidably movable therealong. Telescoping slide means 42 preferably will define a slot means 44 therealong adjacent to one edge of the telescoping slide means 42 such that in the steady state condition the sides of slot means 44 will extend about both sides of the neck of ball means 38 and thereby movably retain ball means 38 within socket means 40 while still allowing movement in the manner shown by arrows 32 and 34.

To facilitate this interconnection between slot means 44 and ball means 38, a biasing means 46 may take the form of a coil spring means 48 extending about the outer surface of the second handle means 22 and about the inside diameter of the telescoping slide means 42 in such a manner as to bias the telescoping slide means 42 and the slot means 44 thereof into position retaining ball means 38 within socket means 40. Upon movement by the user against biasing means 46, the slot means 44 may be removed from the immediate vicinity of the socket means 40 and allow the ball means 38 to be removed therefrom for replacement or usage of a differently sized thumb loop means 28.

To somewhat restrict movement of ball means 38 within socket means 40 about arrow 62, a tab means 50 may be positioned therein extending downwardly therefrom such as to be adapted to contact the handle means upon movement of the thumb loop means 28 through a certain degree of rotational movement. In this manner, the side of the thumb loop means 28 designed to receive the thumb will always be facing approximately away from first blade means 14 and second blade means 20. This is facilitated by the fixedly secure attachment between the ball means 38 and the thumb loop means 28.

To control the closing movement of the first and second blade means 14 and 20 with respect to one another, a stop means 52 may be positioned adjacent to the inner sides of the handle means. This stop means provides a point of abutment to limit the degree of collapsing movement of the first and second handle means 16 and 22 with respect to one another. To make this closing more gentle, a rubber tip 54 may be included to cushion the closing movement.

To further facilitate control and gripping by the first gripping means 24, a finger loop 56 may be fixedly secured with respect to first handle means 16. This finger loop will be designed to allow the finger of the user to extend therethrough when the thumb of the user is extended through the thumb loop means 28. This finger loop will be of a predetermined size, however, it can be made smaller or the size thereof can be varied by the usage of an O-ring means 60 extending about the inner periphery thereof. This O-ring means may be of various sizes to allow for various size fingers or it may be of a rubber construction to facilitate control and grasping of the first gripping means 24.

To further facilitate control of french lip 58, it may be positioned extending away from the finger loop 56 in such a manner as to allow the pinky finger or any other finger to rest thereagainst to further provide control of operation of the scissors 10 for the user.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

What is claimed is:

1. A scissors comprising:

(a) a first member including a first blade means at one end thereof and a first handle means at the other end thereof;

(b) a second member including a second blade means at one end thereof and a second handle means at the other end thereof, said second member being pivotally secured, at a point between said second blade means and said second handle means, to said first member, at a point between said first blade means and said first handle means, with said first and second blade means adjacent to one another for cutting therebetween;

(c) a first gripping means on said first handle means to facilitate gripping of said first handle means by the fingers of the user;

(d) a second gripping means on said second handle means to facilitate movable securement of the thumb of the user with respect to said second handle means, said second gripping means comprising a thumb loop means movably secured with respect to said second handle means to allow pivotal movement of said thumb loop means longitudinally along and perpendicularly around the axis of said second handle means; and (e) movable interconnecting means comprising;

(1) a ball means fixedly secured with respect to said thumb loop means;

(2) a socket means defined in said second handle means and adapted to receive said ball means therein to provide a ball and socket interconnection between said thumb loop means and said second handle means;

(3) a telescoping slide means extending about said second handle means and in telescoping movable engagement therewith, said telescoping slide means positioned adjacent to said socket means and defining a slot means selectively registrable therewith, said slot means adapted to retain said ball means within said slot means while allowing movement of said ball means and said thumb loop longitudinally along and perpendicularly around the axis of said second handle means.

2. The scissors as defined in claim 1 further including a biasing means between said second handle means and said telescoping slide means to urge said telescoping slide means to a position retaining said ball means within said slot means.

3. The scissors as defined in claim 3 wherein said biasing means comprises a coil spring means wrapped about said handle means within said telescoping slide means.

4. The scissors as defined in claim 1 further including a tab means fixedly secured with respect to said thumb loop means and extending downwardly therefrom and positioned to selectively abut said second handle means and limit movement of said thumb loop means with respect thereto.

5. The scissors as defined in claim 1 further including a stop means fixedly secured with respect to said first handle means and extending toward said second handle means to limit movement of said first handle means and second handle means toward one another.

6. The scissors as defined in claim 1 further including a stop means fixedly secured with respect to said second handle means and extending toward said first handle means to limit movement of first handle means and said second handle means toward one another.

7. The scissors as defined in claim 5 further including a rubber tip means fixedly secured to said stop means.

8. The scissors as defined in claim 6 further including a rubber tip means fixedly secured to said stop means.

9. The scissors as defined in claim 1 wherein said first handle means comprises a finger loop.

10. The scissors as defined in claim 9 further including a french lip to facilitate finger control of said second handle means.

11. The scissors as defined in claim 9 further including an O-ring means being detachably securable about the inner surface of said finger loop to facilitate control thereof.

12. A scissors comprising:

(a) a first member including a first blade means at one end thereof and a first handle means at the other end thereof, said first handle means defining a finger loop thereon and including a french lip extending outwardly therefrom;

(b) a second member including a second blade means at one end thereof and a second handle means at the other end thereof, said second member being pivotally secured, at a point between said second blade means and said second handle means, to said first member, at a point between said first blade means and said first handle means, with said first and second blade means adjacent to one another for cutting therebetween;

(c) a first gripping means on said first handle means to facilitate gripping of said first handle means by the fingers of the user;

(d) a second gripping means on said second handle means to facilitate movable securement of the thumb of the user with respect to said second handle means, said second gripping means comprising a thumb loop means movably secured with respect to said second handle means to allow pivotal movement of said thumb loop means longitudinally along and perpendicularly around the axis of said second handle means;

(e) a movable interconnecting means securing said thumb loop to said second handle means which further comprises:

(1) a ball means fixedly secured with respect to said thumb loop means;

(2) a socket means defined in said second handle means and adapted to receive said ball means therein to provide a ball and socket interconnection between said thumb loop means and said second handle means;

(3) a telescoping slide means extending about said second handle means and in telescoping movable engagement therewith, said telescoping slide means being positioned adjacent to said socket means and defining a slot means selectively registrable therewith, said slot means adapted to retain said ball means within said slot means while allowing movement of said ball means and said thumb means longitudinally along and perpendicularly around the axis of said second handle means; and (4) a biasing means comprising a coil spring means wrapped around said handle means within said telescoping slide means to urge said telescoping slide means to a position retaining said ball means within said slot means;

(f) a tab means fixedly secured with respect to said thumb loop means and extending downwardly therefrom and positioned to selectively abut said second handle means and limit movement of said thumb loop means with respect thereto; and (g) an O-ring means being detachable about the inner surface of said finger loop to facilitate control thereof.

13. The scissors as defined in claim 12 further including a stop means fixedly secured with respect to said first handle means and extending toward said second handle means to limit movement of said first handle means and second handle means with respect to one another.

14. The scissors as defined in claim 12 further including a stop means fixedly secured with respect to said second handle means and extending toward said first handle means to limit movement of said first handle means and said second handle means toward one another.

15. The scissors as defined in claim 13 further including a rubber tip means fixedly secured to said stop means.

16. The scissors as defined in claim 14 further including a rubber tip means fixedly secured to said stop means.

* * * * *